US008465363B1

(12) United States Patent
Mayeroff

(10) Patent No.: US 8,465,363 B1
(45) Date of Patent: Jun. 18, 2013

(54) NETWORKED GAMES WITH THEORETICAL RETURN EXCEEDING 100% AND NON-CASH AWARDS

(71) Applicant: Ketavong Holdings, LLC, Santa Fe, NM (US)

(72) Inventor: Jason Myles Mayeroff, Reno, NV (US)

(73) Assignee: Ketavong Holdings, LLC, Santa Fe, NM (US)

( * ) Notice: Subject to any disclaimer, the term of this patent is extended or adjusted under 35 U.S.C. 154(b) by 0 days.

(21) Appl. No.: 13/654,392

(22) Filed: Oct. 17, 2012

Related U.S. Application Data

(63) Continuation-in-part of application No. 13/492,006, filed on Jun. 8, 2012.

(51) Int. Cl.
*A63F 9/24* (2006.01)

(52) U.S. Cl.
USPC ..... 463/25; 463/16; 463/20; 463/40; 463/42

(58) Field of Classification Search
USPC ..... 463/11–13, 16–21, 25, 40–42; 705/14.1, 705/14.12, 14.4
See application file for complete search history.

(56) References Cited

U.S. PATENT DOCUMENTS

| | | | | |
|---|---|---|---|---|
| 5,816,918 | A * | 10/1998 | Kelly et al. | 463/16 |
| 6,609,969 | B1 | 8/2003 | Luciano | |
| 2005/0043087 | A1 | 2/2005 | Seelig | |
| 2008/0045317 | A1 | 2/2008 | Seelig | |
| 2008/0188294 | A1 * | 8/2008 | Seelig et al. | 463/26 |
| 2008/0287187 | A1 | 11/2008 | Seelig | |

OTHER PUBLICATIONS

The Wizard of Odds, "Deuces Wild", Apr. 7, 2006 http://wizardofodds.com/games/video-poker/tables/deuces-wild/.

* cited by examiner

*Primary Examiner* — Damon Pierce

(57) ABSTRACT

A networked gaming system and method for offering interactive games with a theoretical return or payback to the player exceeding 100% of the amount wagered on the game over time by awarding the player with non-cash awards such as merchandise or services, or vouchers to purchase merchandise or services that have been purchased in bulk by the gaming website or game operator. The gaming system and method are offered and deployed on internet connected devices such as general purpose computing devices, tablet computers, mobile telephones, smartphones, personal computers and dedicated gaming devices such as an "Xbox" or "PSP."

30 Claims, 13 Drawing Sheets

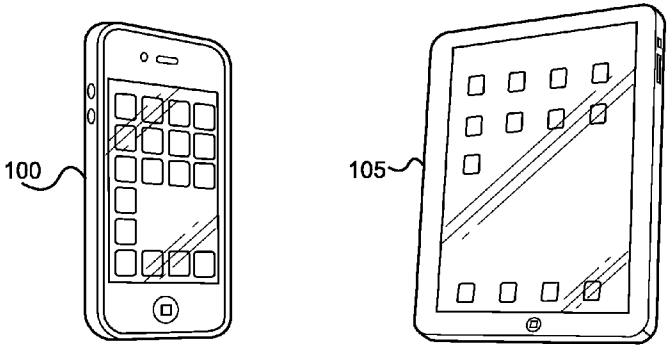
FIG. 1A
FIG. 1B
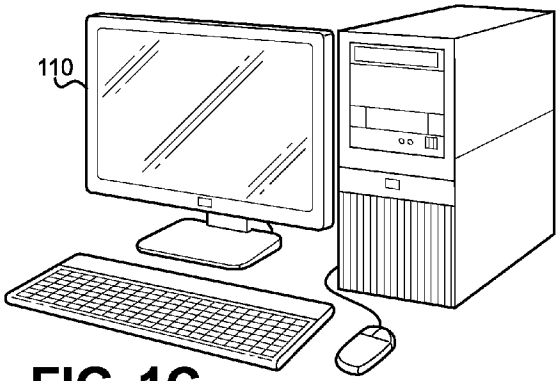
FIG. 1C
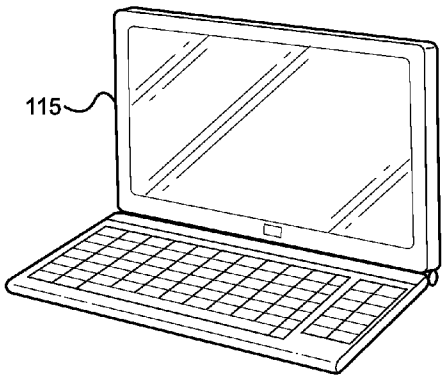
FIG. 1D
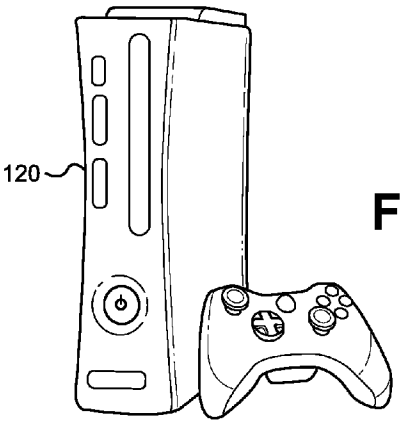
FIG. 1E

503 Casino

503 Player

505 Player

505 Casino

507 Casino

507 Player

| | A | B | C | D | E | F | G | | I | J | K | L |
|---|---|---|---|---|---|---|---|---|---|---|---|---|
| 1 | SHOP N' FLY VIDEO POKER | | | | | | | | | | | |
| 2 | | | | | | | | | | | | |
| 3 | Video Poker Example | | Jacks or Better | 1 Dollar denomination | | | | | | | | |
| 4 | | | | | | | | | | | | |
| 5 | FINANCIAL ANALYSIS FOR THE GAME WEBSITE | | | | | | | FINANCIAL ANALYSIS FOR PLAYER | | | | |
| 6 | | | | | | | | | | | | |
| 7 | Hand | 1 Dollar Pay | 5 Dollar Pay | Probability | Contribution at 5 dollar bet | | | Hand | 1 Dollar Pay | 5 Dollar Pay | Probability | Contribution at 5 dollar bet |
| 8 | Royal Flush | 250 | 4000 | 0.0000247586036 | 1.9806882892% | | | Royal Flush | 250 | 4000 | 0.0000247586036 | 1.9806882892% |
| 9 | Straight Flush | 50 | 250 | 0.000109314 | 0.5465675557% | | | Straight Flush | 50 | 250 | 0.000109314 | 0.5465675557% |
| 10 | 4 of a Kind | 25 | **125** | 0.002364066 | 5.9101654846% | | | 4 of a Kind | 25 | **150** | 0.002364066 | 7.0921985816% |
| 11 | Full House | 8 | **40** | 0.011627907 | 9.3023255814% | | | Full House | 8 | **50** | 0.011627907 | 11.6279069767% |
| 12 | Flush | 5 | **25** | 0.0111111111 | 5.5555555556% | | | Flush | 5 | **30** | 0.0111111111 | 6.6666666667% |
| 13 | Straight | 4 | 20 | 0.011235955 | 4.4943820225% | | | Straight | 4 | 20 | 0.011235955 | 4.4943820225% |
| 14 | 3 of a Kind | 3 | 15 | 0.074626866 | 22.3880597015% | | | 3 of a Kind | 3 | 15 | 0.074626866 | 22.3880597015% |
| 15 | 2 Pair | 2 | 10 | 0.12987013 | 25.9740259740% | | | 2Pair | 2 | 10 | 0.12987013 | 25.9740259740% |
| 16 | 1 Pair Jacks or Better | 1 | 5 | 0.21507064 | 21.5070640000% | | | 1 Pair Jacks or Better | 1 | 5 | 0.21507064 | 21.5070640000% |
| 17 | Losing Hand | 0 | 0 | 0.546448087 | 0.0000000000% | | | Losing Hand | 0 | 0 | 0.546448087 | 0.0000000000% |
| 18 | | | **PAYBACK TO THE GAME WEBSITE** | | **97.6588341645%** | | | | | **PAYBACK TO THE PLAYER** | | **102.2775597679%** |
| 19 | | | | | | | | | | | | |
| 20 | Notes: | | | | | | | | | | | |
| 21 | 4 of a kind pay is a $150 voucher on "Best West Airlines" that was purchased in bulk by the game wesbite for $125. | | | | | | | | | | | |
| 22 | | | | | | | | | | | | |
| 23 | Full House pay at 5 dollars bet is a $50 voucher for shopping at "Mall Mart" Department Stores. The game website purchased this in bulk for $40. | | | | | | | | | | | |
| 24 | | | | | | | | | | | | |
| 25 | Flush pay at 5 dollars bet is a 30 dollar voucher for shopping at "Acme Supermarkets" The game website purchased this in bulk fir $25. | | | | | | | | | | | |
| 26 | | | | | | | | | | | | |
| 27 | | | | | | | | | | | | |
| 28 | Player must play 5 dollars in order to be eligible for vouchers. | | | | | | | | | | | |
| 29 | | | | | | | | | | | | |
| 30 | | | | | | | | | | | | |

501

FIG. 5A

511

| | A | B | C | D | E | F | G | H | I | J | K | L | M |
|---|---|---|---|---|---|---|---|---|---|---|---|---|---|
| 7 | $200 Voucher for SouthBest Airlines | | | | | | | 3B | 3 Bar | | | | |
| 8 | $200 Acme Hotel Chain Voucher | | | | | | | 2B | 2 Bar | | | | |
| 9 | Note: AB= Any Bar | | | | | | | 1B | 1 Bar | | | | |
| 10 | | | | | | | | AB | Any Bar | | | | |
| 11 | Cost Basis for each non-cash prize is $150 | | | | | | | ~~ | BLANK | | | | |
| 12 | | | | | | | | | | | | | |
| 13 | Note: Every other winning combination (except for R7 R7 R7) awards the player playable game credits that can be re-playerd in the game. | | | | | | | | | | | | |
| 14 | | | | | | | | | | | | | |
| 15 | Virtual Symbol Distribution | | | | | Mathematical Analysis | | | | | | | |
| 16 | Symbol | Reel 1 | Reel 2 | Reel 3 | | Combination | PLayer Pay / Coin In | Game Website Pay Coin In | Hits | Probabilty | Odds | Player Contribution | House Contribution |
| 17 | D1 - Diamond (Wild Symbol) | 2 | 1 | 1 | | D1 D1 D1 | 500 | 500 | 2 | 0.00000762939 | 131072 | 0.381469726563% | 0.381469726563% |
| 18 | R7 - Red 7 | 11 | 11 | 10 | | R7 R7 R7 | **66.666666667** | **50** | 1714 | 0.00653839111 | 152.9428238 | 43.589274088542% | 32.69195566406% |
| 19 | 3B - 3 Bar | 6 | 6 | 8 | | 3B 3B 3B | 30 | 30 | 502 | 0.00191497803 | 522.1992032 | 5.744934082031% | 5.744934082031% |
| 20 | 2B - 2 Bar | 8 | 8 | 10 | | 2B 2B 2B | 20 | 20 | 988 | 0.00376892090 | 265.3279352 | 7.53784196875% | 7.53784196875% |
| 21 | 1B - 1 Bar | 13 | 12 | 10 | | 1B 1B 1B | 10 | 10 | 2143 | 0.00817489624 | 122.3257116 | 8.174896240234% | 8.174896240234% |
| 22 | ~~ - BLANK | 24 | 26 | 25 | | AB AB AB | 5 | 5 | 19072 | 0.07275390625 | 13.7449644 | 36.376953125000% | 36.376953125000% |
| 23 | TOTALS | 64 | 64 | 64 | | D1 D1 ~~ | 5 | 5 | 50 | 0.00019073486 | 5242.88 | 0.095367431641% | 0.095367431641% |
| 24 | | | | | | D1 ~~ D1 | 5 | 5 | 52 | 0.00019836426 | 5041.230769 | 0.099182128906% | 0.099182128906% |
| 25 | cycle size= | 262144 | | | | ~~ D1 D1 | 5 | 5 | 24 | 0.00009155273 | 10922.66667 | 0.0457763671488% | 0.0457763671488% |
| 26 | | | | | | D1 ~~ ~~ | 2 | 2 | 1300 | 0.00495910645 | 201.6492308 | 0.991821289063% | 0.991821289063% |
| 27 | PLAYER PAYBACK PERCENTAGE | | | | | ~~ D1 ~~ | 2 | 2 | 600 | 0.00228881836 | 436.9066667 | 0.457763671875% | 0.457763671875% |
| 28 | 103.9714% | | | | | ~~ ~~ D1 | 2 | 2 | 624 | 0.00238037109 | 420.1025641 | 0.476074218750% | 0.476074218750% |
| 29 | GAME WEBSITE PAYBACK PERCENTAGE | | | | | TOTALS | | | | **0.10326766968** | **9.683572827** | **103.9713541667%** | **93.074035644531%** |
| 30 | 93.0740% | | | | | | | | | | | | |
| 31 | | | | | | | | | | | | | |

515 513

FIG. 5B

NETWORKED GAMES WITH THEORETICAL RETURN EXCEEDING 100% AND NON-CASH AWARDS

RELATED CASE INFORMATION

This case is a continuation-in-part of U.S. patent application Ser. No. 13/492,006 filed Jun. 8, 2012, entitled "Networked Games with Payback Exceeding 100% and Non-Cash Awards."

COPYRIGHT NOTICE

Portions of this disclosure contain material in which copyright is claimed by the applicant. The applicant has no objection to the copying of this material in the course of making copies of the application file or any patents that may issue on the application, but all other rights whatsoever in the copyrighted material are reserved.

BACKGROUND

For purposes of this application, the term "game" is intended to cover games of all types, including but not limited to: (1) games of chance and traditional casino-style games such as reel slot games, video poker, video keno, baccarat, craps, blackjack, sic-bo and pai-gow; (2) games of skill such as fighting games, path games, role-playing games, driving games, shooting games, decision-making games, multi-player social games, simulation games, social-network games and similar products; and (3) hybrid games that include a chance and a skill component. It should be further understood that the term "game" applies to a game played anywhere over a server-connected network such as the internet, a local area network, a wide area network and accessed by a computing device such as a personal computer, a tablet computer, a smartphone or other mobile computing device, a dedicated gaming console such a Microsoft Xbox, a Sony Playstation, Playstation Portable (PSP), a Nintendo Wii, or any other similar device capable of play using application based functionality, browser based functionality or other functionality allowing interaction between the device and other devices connected to the network.

Typically, internet-based or web-based game operators offer a variety of games commonly deployed for use by players in a local or distributed manner with software for game play residing on a server, on a player's game device in the form of an applet, application or app that is distributed in component parts between the server and the player's game device. For purposes of this application, the term "network connected devices" or "NCDs" will be used to refer to devices for playing games. Playing of these games with an opportunity to win either credits or redeemable points (referred to as "points") typically requires the player to finance game activities with their own money by purchasing credits. From the player's perspective, the most unappealing feature of the games is that mathematically, over time, the games are programmed to return a theoretical percentage of the credits wagered that is less than one hundred percent (100%). Players know that these games are programmed to provide the game operator with a mathematical advantage. In fact, there is a general understanding among players that in order for a gaming website or operator of the game to continue to operate as a sustainable business, the games must give the gaming operator a mathematical advantage over the player. Nevertheless, players also understand that they may get lucky over the short-term, or on any individual game play and be able to cease gaming activities with a point profit in hand.

An example of a theoretical return percentage is ninety-five percent (95%). In the case of a 95% theoretical return game, the game is programmed to return 95 cents of every dollar wagered by the player. In mathematical terms, this means that the game is designed so that the combined value of each of the possible winning and losing outcomes, multiplied by the corresponding probability of each of the possible winning and losing outcomes respectively, when added together, is 0.95. For the player, this is a losing proposition over the long-term and this is well understood by experienced players of wagering games. However, the prospect of getting ahead in the short-term is what motivates players to play games with less than a 100% return, in the hope that they will be a winner on any given play, or on any given sequence of play over a short period of time where the sample size and the true statistical probabilities may not always equate to the longer term reality that the player will lose 5 cents of every dollar wagered.

It is noted that there have been certain games where the percentage returned exceeds 100%. Among such games have been video poker games. However, for the player to receive a return exceeding 100% over the long-term on such games, the player must play optimal strategy on each and every hand over a long period of time. While experienced poker players tend to be well informed about the mathematical probabilities on any given hand, it is difficult even for them to resist going for a high payout hand when optimal strategy would dictate that they do something different. As a result, even in circumstances where a game is set with a theoretical return percentage exceeding 100%, the actual payout percentage for such games is usually below 100%.

The present invention defines a system and method that overcomes the disadvantages inherent in the play of player-financed games. In particular, the present invention recognizes that the game operator or gaming website needs to generate revenue for the game operator or gaming website but it also overcomes the need to generate revenue at the sole expense of the player. The present invention accomplishes this "win-win" arrangement by setting the theoretical return percentage above 100%. The invention utilizes bulk, wholesale purchases of goods and/or services, to compensate for the differential between a typical return percentage below 100% and a player-friendly return percentage above 100%. These goods and/or services are acquired from third party vendors and are designed to be desirable prizes so that the player is willing, and even excited to play the game in order to win non-cash prizes, and possibly, cash as well. At the same time, the vendor of the product or service, and the gaming website or game operator also receive benefits from the arrangement in the form of a new sales channel for the vendor, and a product that is more appealing to customers for the gaming website or game operator without a reduction in profits.

BRIEF DESCRIPTION OF THE DRAWINGS

For a better understanding of the present invention, and to show more clearly how it functions, reference will now be made, by way of example, to the accompanying drawings. The drawings show embodiments of the present invention in which:

FIGS. 1A-1E show network computing devices for playing a game;

FIG. 5A shows a sample probability table for a poker game with merchandise awards;

FIG. 5B shows a sample probability table for a slot game with non-cash awards;

DETAILED DESCRIPTION OF THE INVENTION

Figure 1F:
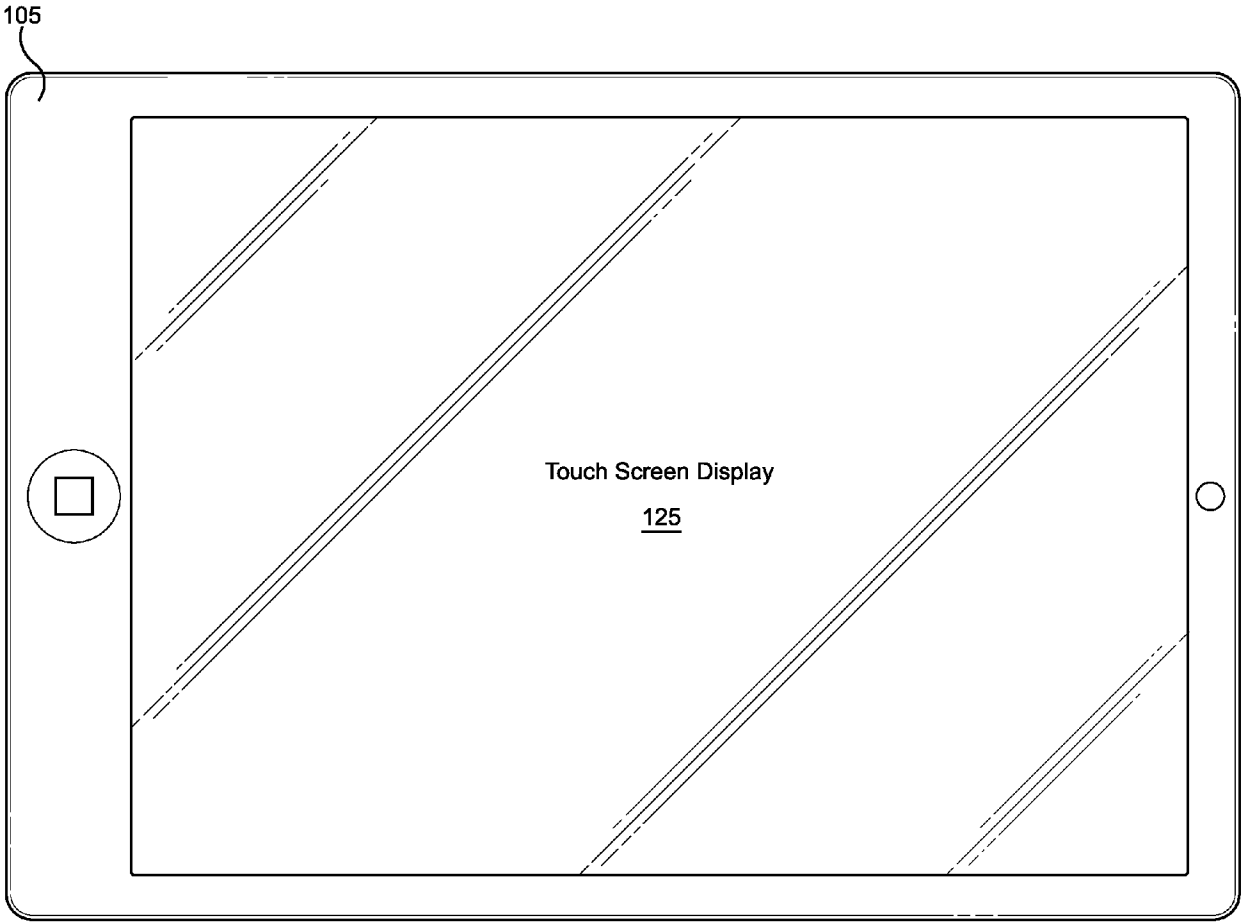
FIG. 1F shows a touchscreen display for a game on an individual NCD that is a tablet computer.

The present invention will now be described more fully with reference to the accompanying drawings. It should be understood that the invention may be embodied in many different forms and should not be construed as limited to the embodiments set forth herein. Throughout FIGS. 1-9, like elements of the invention are referred to by the same reference numerals for consistency purposes.

FIGS. 1A-1E show a number of general network computing devices ("NCDs") which may be used to play a game. These figures show a smartphone 100 in FIG. 1A which may be an Apple iPhone 4S® as pictured, or any other mobile phone type device. A tablet computer 105 is shown in FIG. 1B which may be an Apple iPad 3® as pictured, or any other tablet computing device. A desktop computer 110 is shown in FIG. 1C which may be a Lenovo® machine as pictured, or any other desktop computer. A laptop computer 115 is shown in FIG. 1D which may be a Lenovo® computer or any other laptop computer. And, a home video gaming device 120 is shown in FIG. 1E which may be a Microsoft Xbox® system or any other home video system. Other types of network connected devices could also be used to play games including portable video gaming devices such as a Sony PSP®, a Nintendo GameBoy®, or an internet connected television with a browser or app capabilities. Any of these devices is capable of playing a game, including a wagering game, through an app loaded onto the device or through a website accessible using a browser on the device. In the case of the networked game, payment may be made by credit card, Paypal® or another payment service, and the RNG is run securely on server based system 200 and then delivering outcomes over the internet to be displayed on the particular NCD.

FIG. 1F shows a game display screen 125 on a tablet computer 105 used to display a game with a number of visual elements. Display 125 is used to show game play and resulting outcomes on any of the devices in FIGS. 1A-1E. Game display screen 125 may be of any type including but not limited to a flat screen liquid crystal display ("LCD"), a screen using light emitting diode ("LED") technology, a cathode ray tube ("CRT") or any other kind of screen for displaying images. The screen may include a touch screen feature such as that included on an iPhone or an iPad that provides a flexible interface for operation of a NCD, but it is not required and it should be understood that many NCDs such as an Xbox, a desktop or many laptops do not include touch screens. As an alternative, or as a supplement to a touch screen, the NCDs of FIGS. 1A-1E may include other input devices such as a keyboard 130 shown with desktop computer 110 or laptop computer 115, or buttons 135 such as those for use on a game play console 120 like an Xbox.

Figure 2:
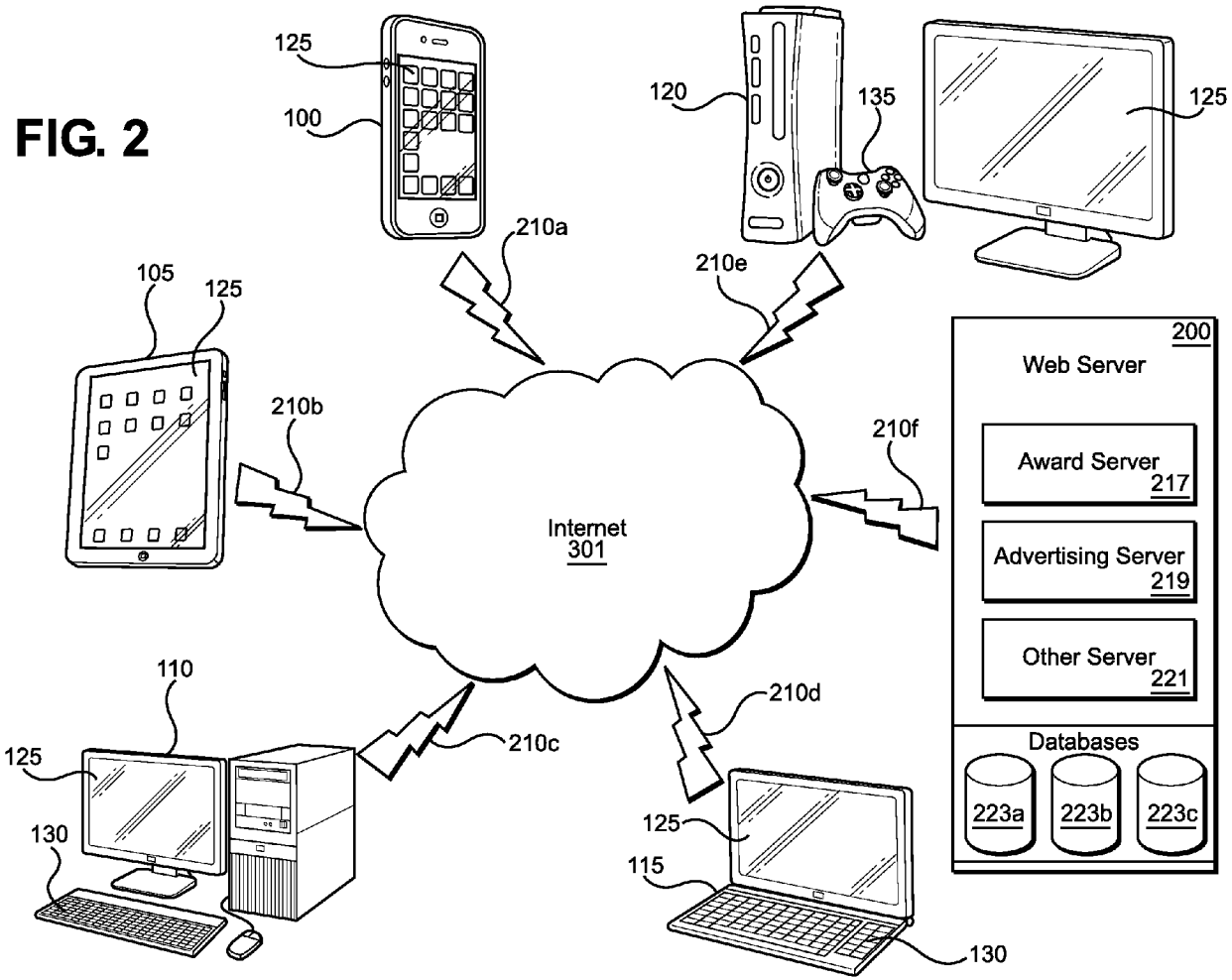
FIG. 2 shows a group of computing devices on a network connected to a server based system.

FIG. 2 is a block diagram of a group of NCDs capable of playing a game with each connected to a web server 200 capable of delivering a game over a network such as internet 205. Each computing device is connected over a network link 210*a-e* with web server 200 connected over link 210*f*. All operational functions of web server 200 are controlled by one or more controllers which are typically microprocessors housed inside web server 200. The controller executes instructions that include operation of a random number generator ("RNG") that is usually implemented in software and stored in a memory in web server 200. The use of one or more web servers 200 to deliver game content and other data to a player are well known to those of ordinary skill in the art. Game outcomes are determined based on the results corresponding to the numbers selected by the RNG.

As shown, server based system 200 has an award server 217 and an advertising server 219. Award server 217 is tasked with maintaining a database of different awards available to be offered to a player and making those awards available to the player at an appropriate time during game play. Advertising server 219 is tasked with maintaining a database of different advertisements to be displayed to a player at an appropriate time and may be based on the awards that a player chooses to play for. A third server 221 is also shown and may be used for overflow operation of either of award server 217 or advertising server 219, or for any other purpose required. Servers 217-221 are shown for illustrative purposes only. Different server configurations may be used with more or fewer servers, or a single server may be employed to handle all functions simultaneously.

Databases 223*a-c* storing different types of information are available to servers 217-221. In one embodiment, a database 223*a* may be used to store award information that is available to award server 217. Similarly, database 223*b* may be used to store advertising information that is available to advertising server 219. While databases 223*a-c* are shown as separate databases, different configurations may be used with more or fewer databases, or a single database may be employed to store all information.

It will be understood that the type of network over which data is communicated can be one of several different types of networks. The includes a Local Area Network (LAN), Wide Area Network (WAN), an intranet or the Internet as depicted in FIG. 2. Other proprietary networks could also be used without departing from the principles of the invention. This would include such networks as a Windows network or an Ethernet network.

FIG. 2 is a block diagram showing a group of NCDs 100-120 with each on a network connection 210*a-e* to web server 200. It should be understood that the network may be set up with any number of NCDs only constrained by the bandwidth of the connection and the power of one or more web servers to deliver game content to the NCDs. Information is communicated between any individual NCD and web server 200 so that a player may be offered a different set of award options that are appealing to that player. For example, one player at smartphone 100 may enjoy travel. For that player, it may be appealing to play for travel related awards such as airline tickets, hotel stays or rental car uses, or a package of all three. Another player using tablet computer 105 may be excited to win a shopping spree at a local department store, while a third player on laptop 125 may enjoy tickets to a sporting event. For any of these awards, a voucher may be electronically transmitted to the player. The voucher may be printed by the player, scanned by a merchant on the player's mobile device, provided in the form of a secure code that may be entered on a website by the player, or sent to the player in any other form that may be used by the player to collect an award for a selected amount given to the player for a winning outcome.

Transmission of vouchers or the collection and reporting of point totals earned that may be used to purchase vouchers or other non-cash prizes can be made securely over internet 205 using connections 210*a-e*, and then delivered to web server 200 over connection 210*f*. As discussed above, the game is executed on web server 200 using a secure RNG with the outcomes being delivered to the individual devices 100-120 over internet 205. Transmission of vouchers or reporting of collected point totals to players may be made using accounts set up with an operator of a website on which the games are run.

Figure 3A:
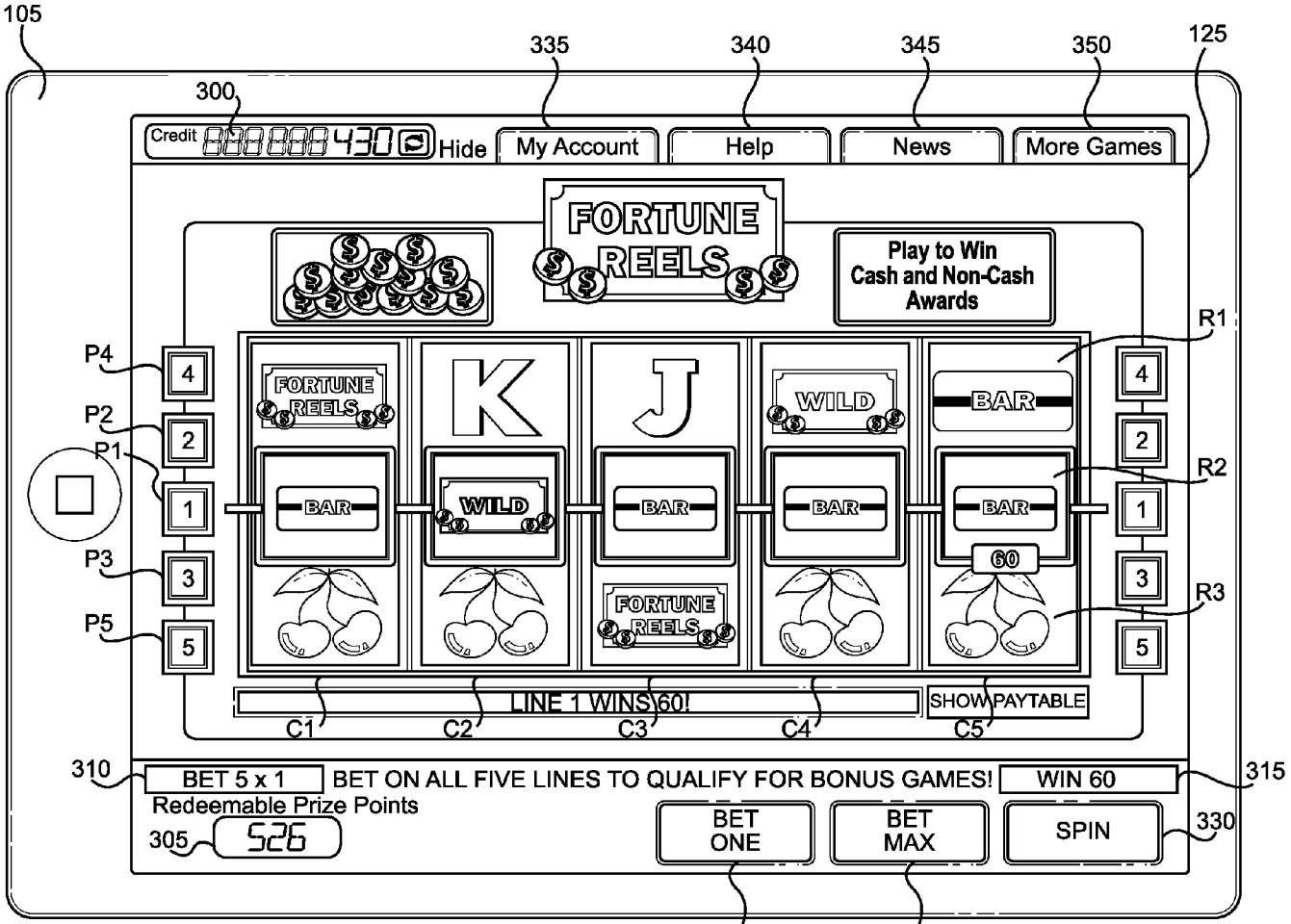
FIGS. 3A-3B show screenshots of a game on a network computing device.

FIG. 3A is a screen shot of a five reel slot game shown on display 125 of tablet computer 105. In this game, five reels are shown in five columns (C1-C5) with each column having three rows (R1-R3). This five-by-three matrix provides fifteen individual positions in which a symbol appears. In this particular example, five paylines are shown (P1-P5) but it should be understood that the number of paylines is a design choice of the game developer and may include a greater or lesser number for any particular game. A payline typically includes a position from each column across the matrix. However, winning combinations may also be on "paylines" that include the four corner positions [(R1, C1), (R3, C1), (R1, C5) and (R3, C5)] or other groupings of pre-defined matrix positions. In the case of FIG. 3A, payline P1 is highlighted and is a horizontal line that includes five matrix positions [(R2, C1), (R2, C2), (R2, C3), (R2, C4) and (R2, C5)]. In addition to a credit meter 300 to show the number of credits currently available for play, a redeemable prize point meter 305 shows the number of points earned by the player that the player may use to redeem for awards. A bet meter 310 shows the number of credits bet per line. In the example of FIG. 3A, the player is betting 5 credits on only a single payline, which is payline 1. A win meter 315 shows the number of redeemable prize points won for the particular game that has just ended. A set of buttons on touchscreen 125 allows the player to operate the game. A "bet one" button 320, a "bet max" button 325 and a "spin" button 330 allow the player to make quick selections during game play.

The player may also navigate on display 125 to other screens using the tabs at the top of the game play screen. For example, the player may touch the "my account" tab 335 to go to a screen with more information about the player's account. The player may touch "help" tab 340 to get information about game play as well as the paytables. A "news" tab 345 may take the player to a screen with new game releases or any other information that might be of interest to the player. And, the "more games" tab 350 provides the player with a selection of other games to play.

Figure 3B:
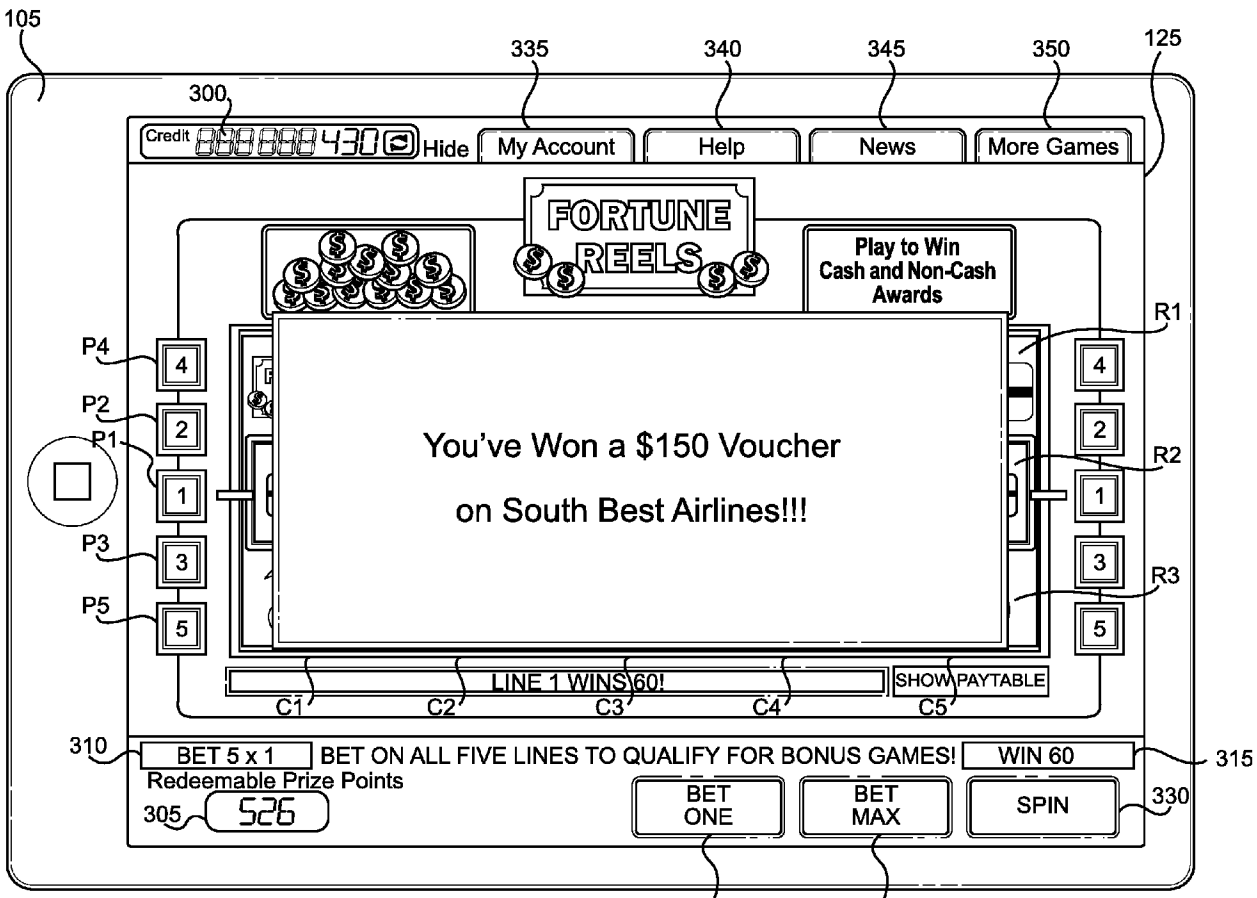

FIG. 3B is a screen shot of a five reel slot game shown on display 125 of tablet computer 105 after the player has won a voucher. In this case, the player is presented with a message indicating the voucher amount is $150 and the supplier of the voucher is South Best Airlines.

Figure 4A:
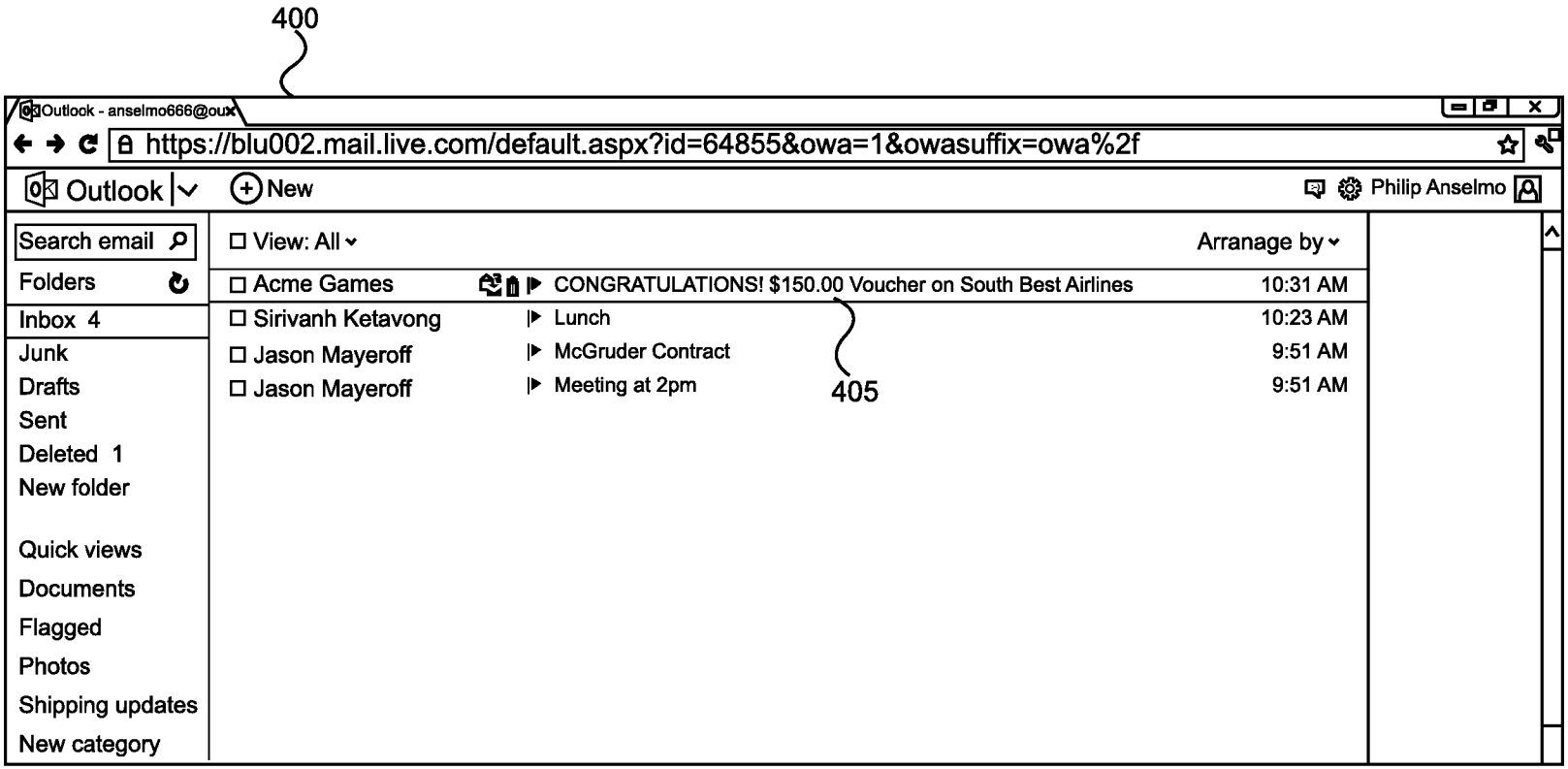
FIG. 4A shows an email inbox with a message including an attached voucher.

FIG. 4A shows an email inbox 400 with a message 405 including an attached voucher. The email has been transmitted to the player after the player has either: a) won the voucher; or b) redeemed points for the voucher. The email inbox is provided by Microsoft Outlook and includes a listing of emails received by the user.

Figure 4B:
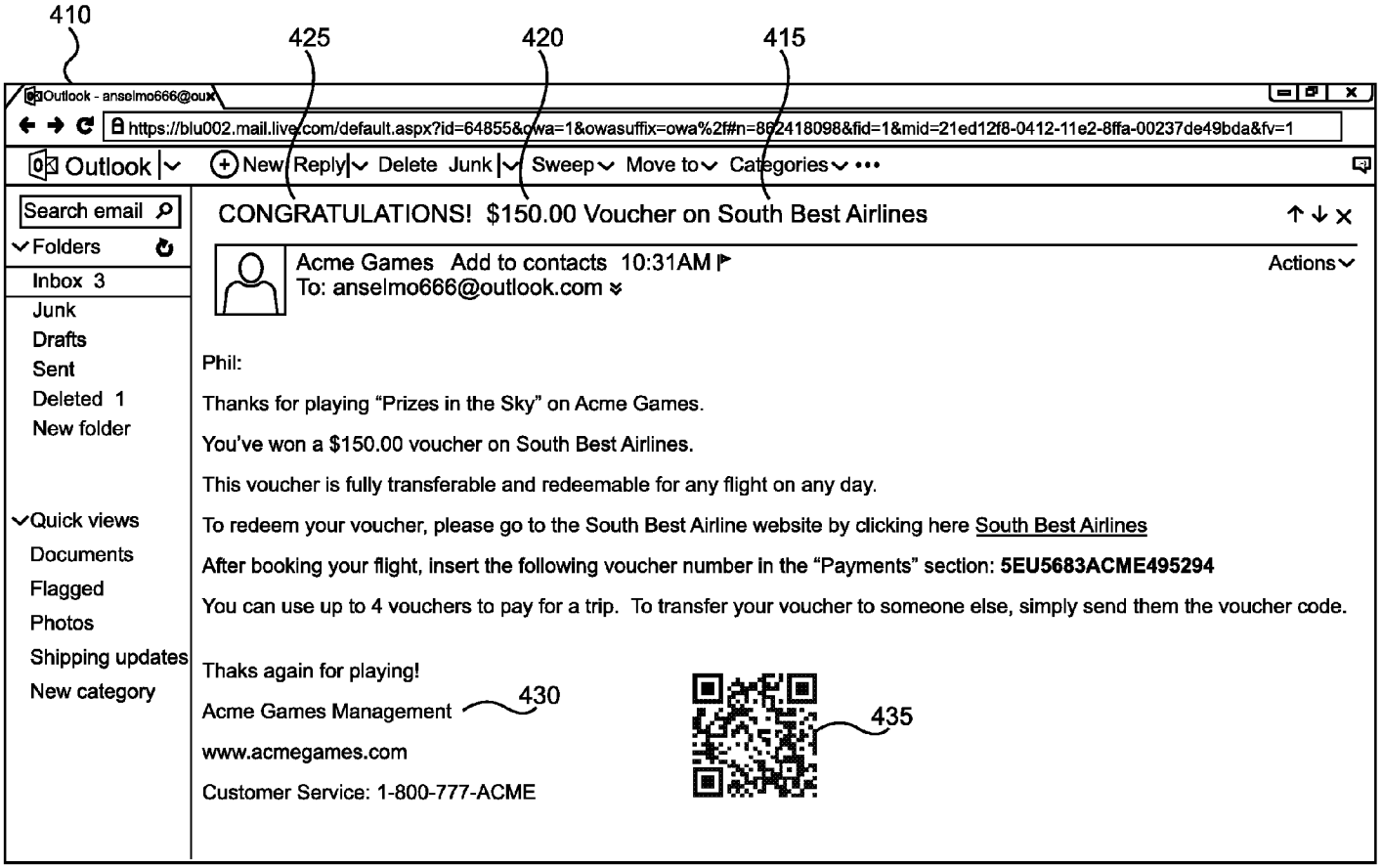
FIG. 4B shows an example of a sample merchandise voucher awarded to a player and subsidized by a third party.

FIG. 4B shows an example of a sample merchandise voucher 410 awarded to a player and subsidized by a third party that was attached to email message 405 sent to the player. The voucher may also simply be the email itself. The particular voucher shown is for South Best Airlines 415 and is in the amount of $150 420. The voucher may include various information such as a congratulatory note 425, the name of the website operator 430, and a bar code 435 to identify and authenticate the ticket for a particular player, and where it was won. The bar code may be a 2-dimensional type or the older one dimensional type (not shown). To use voucher 410, the player need only print it out and present the voucher to the vendor with a personal identification to receive the value of the award. The bar code is maintained on web server 200 in a database and provided to the vendor so that voucher 410 may be authenticated upon presentation by the winning player.

Alternatively, printed voucher 410 may be in electronic form and sent to a player via text message, Twitter, or accessible through a social media site such as Facebook®, Google+®, Twitter®, etc., or on a loyalty award site. In electronic form, voucher 410 may be printed out by the player for presentation to the vendor, or simply presented to a vendor on a mobile device such as mobile phone 100 or tablet computer 105. The voucher may also be made available on a loyalty award site or sent to another individual chosen by the player as a gift.

FIG. 5A is a sample probability table 501 for a game with merchandise awards. The probability table is for a poker game referred to as "Shop 'N Fly Video Poker." The table is similar to a standard video poker table for a "Jacks or Better" video poker game with a $1 denomination. Table 501 shows a financial analysis for the game operator or game website on the left side and a financial analysis for the player on the right side for "hand," "1 dollar pay," "5 dollar pay," "probability" and "contribution at 5 dollars bet" in the columns for each of the game operator and player column groupings respectively. A similar calculation for "contribution at 1 dollar bet" is not included in the figure because in the sample, a $5 bet is required to win the vouchers.

As can be seen in table 501, three of the awards for a 5 dollar bet have been replaced with third party vendor sponsored awards. These awards are for a 4-of-a-kind 503, a full house 505 and a flush 507. For each of these awards, the usual cash prize amount to the player has been substituted with a voucher from a third party entity offering the casino operating the Shop 'N Fly game a non-cash prize in the form of a voucher for products or services. In this case, the 4-of-a-kind that is usually worth a $125 cash prize to the player is replaced with a voucher award having a retail value of $150. The game operator or game website buys the $150 award for $125 (503casino) and is able to offer it to the player at a $150 value (503player) because the third party non-cash award vendor has discounted the purchase price to the game operator or game website based on volume sales or other marketing value. Since the value to the player is $150, the overall payout percentage is increased over the normal $125 payout for 4-of-a-kind.

Similarly, the game operator or game website may offer the player a $50 voucher at Mall-Mart department stores for a full house. A full house is usually paid at $40 and Mall-Mart has sold the voucher to the game operator or game website for $40. The player may also get a $30 voucher at Acme Supermarkets for getting a flush which is normally paid at $25. As with the other two sponsored awards described, the $30 Acme voucher cost the game operator or game website $25. With these substitutions in the paytable, the overall payback percentage for the game website or game operator is about 97% while the overall payback percentage including the retail value of the voucher awards to the player is about 102%. The Shop 'N Fly poker game is therefore more appealing to everyone involved—the player because s/he gets the benefits of playing a game with a higher payback percentage which will pay out more over time, the game operator or game website, because it can maintain the same profitability on the game while paying more out to the player and making that player a happier and more loyal customer, and the third party non-cash award vendor, who makes an increased sale of its products or services and taps into a sales channel that it had not previously enjoyed while doing so at a reasonable cost.

In the particular sample table of FIG. 5A, the voucher and higher probability payout percentage is only offered on a 5 dollar wager. However, it is possible to offer vouchers for play on a 1 dollar wager as well. This is a design choice to be made by the game designer.

FIG. 5B shows a sample probability table 511 for a slot game with merchandise awards that can be played on a NCD. The probability table is for a slot game referred to as "Freedom of Choice Slot Game." The table is similar to a standard slot game table for a three reel, 1 line, 3 coin multiplier in a 1 credit denomination. However, if the player hits 3 red 7s across the payline, the player is given a special merchandise award, which in the example of table 511 is a $200 award voucher that may be selected by the player between: 1) a Mall-Mart gift card; 2) a South Best Airlines card; or 3) 2 free nights at a hotel.

As can be seen in table 511, one of the awards for has been replaced with the special award selected by the player. This award is provided to the player when s/he lines up three red 7s across the payline. For this symbol combination, the usual cash prize amount to the player of 150 credits has been substituted with a voucher from a third party entity offering the casino operating the Freedom of Choice slot game a non-cash prize in the form of a voucher for products or services. In this case, the three red 7s combination that is usually worth a 150 credit prize to the player is replaced with a voucher award having a retail value of $200. The game operator or game website buys the $200 award for $150 as can be seen at table entry 513 (three times multiplier applied to a value of 50) and is able to offer it to the player at a $200 value as can be seen at table entry 515 (three times multiplier applied to a value of 66.666) because the third party vendor sponsoring the prize has discounted the purchase price to the game operator or game website based on volume sales or other marketing value. Since the value to the player is $200, the overall payout percentage is increased over the normal 150 credit payout for three red 7s.

With this substitution in the paytable, the overall payback percentage for the casino is about 93% while the overall payback percentage to the player is about 103%. The Freedom of Choice slot game is therefore more appealing to everyone involved—the player because s/he gets the benefits of playing a game with a higher pay percentage, which will pay out more over time, the game website or game operator, because it can maintain the same profitability on the game while paying more out to the player and making that player a happier and more loyal customer, and the third party non-cash award vendor, who increases sale of its products or services and taps into a sales channel that it had not previously enjoyed while doing so at a reasonable cost.

In the particular sample table of FIG. 5B, the voucher and higher probability payout percentage is only offered on a 3 credit multiplier wager. However, it is possible to offer vouchers for play on a 4 credit wager, which may be the equivalent of a $1 wager on a physical slot machine, as well. This is a design choice to be made by the game designer.

Figure 6:
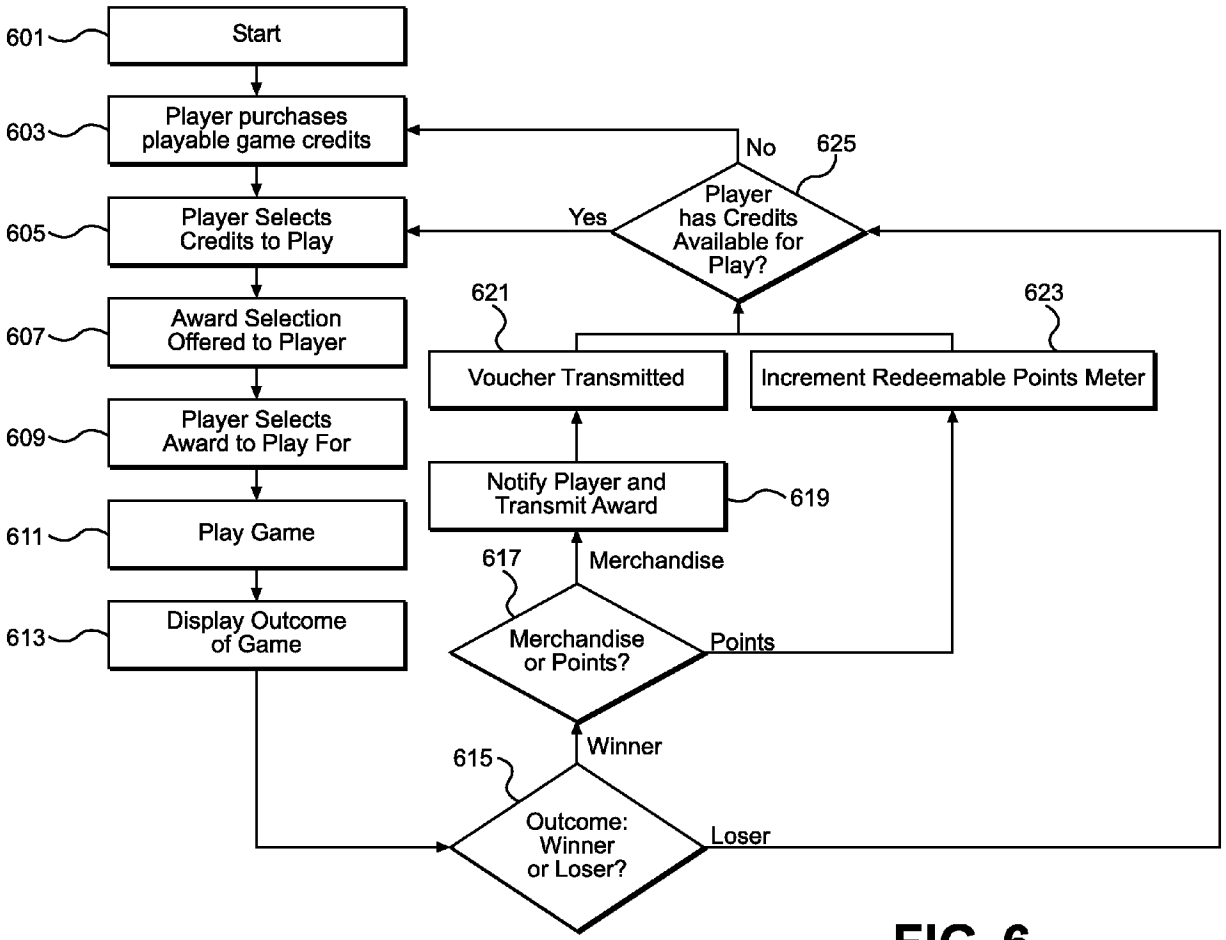
FIG. 6 shows a flow chart of game play with an opportunity for a player to win non-cash awards.

FIG. 6 shows a flow chart of game play with an opportunity for a player to win non-cash awards in the form of products and services. Start 601 represents the point at which a player initiates interaction with a game at the NCD. The player initially enters credit card or other payment information to purchase credits 603 available for play on the NCD. These credits may be displayed to the player on credit meter 300. The player then selects the number of credits to play at step 605 using an input device such as touch screen 125 or buttons on keyboard 130 to initiate game play. Before the game actually begins, a player is offered an award selection at step 607. The award selection may be a single step where the player is given a simple choice among two or more pre-determined awards at a given prize level. For the 150 credit prize, the player may choose a $150 voucher for: 1) an airline flight; 2) a shopping spree at a department store; or 3) a pair of tickets to a sporting event. The choices are made available to the NCD by web server 200, and more particularly by award server 217 from awards that are available in award database 223*a*. The awards are entered into web server 200 by the website operator based on agreements reached between the website operator and third party sponsors seeking to sell non-cash prizes to consumers accessing the game on the operator's website. Award choices are updated on a continuous basis as new awards are added to database 223*a* by the website operator.

To give the player greater control over award selections, an additional step may be added where the awards to be offered are broken out into different award categories. Before choosing a particular award, the player may first choose an award category such as "Travel," "Merchandise," or "Tickets," although it should be understood that there may be many categories from which a player may choose. The categories are maintained on database 223*a* in web server 200. Once a player has selected a category, the player is given an opportunity to select from a group of awards in the category for which to play. If a player has chosen the travel category, the player will be offered the choice of different travel awards such as a flight voucher on an airline, a hotel stay voucher or a car rental voucher. If the player chooses the Merchandise category, s/he may play for a gift voucher of the specified amount at a department store or a shopping spree worth a particular amount at a grocery store. Similarly, for the Ticket category, the player may choose between concert tickets, a sporting event or a play, among many other potential choices.

Selection of the award category and/or the particular award is done on the particular NCD by presenting selection on display 125 and offering the player an opportunity to make a selection through touch screen game display 125 or through the use of buttons on a keyboard 130 at step 609. It should also be understood that non-cash award selection by the player is not necessary at all and that the website operator may predetermine the non-cash award. In that case, step 605 is removed from the process and the player wins the non-cash award established by the website operator.

Once the non-cash award has been established, the game is played at step 611 including appropriate game graphics shown on display 125 in FIG. 3A and game sounds from speakers on the NCD. In this step, RNG 135 is also executed on the controller in web server 200 and a game outcome is chosen. Once the outcome is reached, the outcome is displayed on display 125 for the player to see at step 613. It is determined whether the outcome is a winner or loser at step 615. If it is a losing outcome, it is first determined whether the player has credits available to play at step 625. If not, the player is returned to step 603 to purchase additional credits. If so, the player is returned to step 605 to play available credits and the game process starts over again. If it is a winning outcome at step 615, it is next determined whether the player has won non-cash prizes or redeemable points. If non-cash prizes, the player is notified that s/he has won at step 619 and an electronic voucher is transmitted to the player at step 621. If the player has won points at step 617, the points are added to the redeemable points meter 305 at step 623. Once the voucher is transmitted at step 621 or the redeemable points meter has been incremented, it is determined whether the player has credits remaining available for play. If so, the player is returned to step 605 to select the number of credits to play. If not, the player is returned to step 603 where he may purchase additional credits for further play.

If the player is finished playing, the player may leave remaining available credits in his account or seek to cash out credits and/or redeemable points won. Such a cash-out event may be handled by crediting the player in the same manner in which original payment was made by credit card, Paypal or some other form. Or, alternatively the player may be provided with the voucher electronically by sending it in an email message, a text message or a twitter message, or by making the voucher electronically available in the player's online loyalty account, or through a social media site such as Facebook, or though any other form. The voucher may also be sent as a gift to an individual of the player's choosing, either electronically or in printed form. If the player is eligible for a non-cash award, a voucher for the non-cash prize is printed from a printer connected to the NCD, or otherwise provided to the player as described with respect to the award information at step 621 and including a bar code or some other form of data security to ensure that the voucher has a unique identification that can be confirmed when presented by the player. The bar code is provided by award server 217 and that same bar code is delivered to the sponsor so that it can be authenticated by the sponsor when presented for use by the player. The printing or transmission of the voucher is also confirmed to award server 217 which removes the award from the available inventory of awards on database 223*a*.

Instead of credits, non-cash prizes or vouchers, a player may alternatively earn redeemable points that may be collected in a player account. The points may be redeemed for prizes such as those described above which may include non-cash prizes such as products or services. To redeem points in a player's account, the game operator may transmit an electronic voucher, mail a physical voucher, directly send the prize to the player or otherwise provide the player with a secure means for exchanging the redeemable points for the selected prize. Prizes may be listed on the operator's website and the player may navigate to the list and select a particular prize using the NCD on which the game is played.

During a game play session, it should be understood that a player preference setting may be established to allow the player to play multiple games in sequence for the same awards without making award selections each time through the sequence of the flow chart of FIG. 6. In that case, the player may be prompted on display 125 to indicate that s/he would like to continue to play for the same awards until a cash-out or other event occurs.

While FIG. 6 describes a process in which a player makes a choice of an award type and a particular award (see description of steps 605, 607), it should be understood that these steps may be eliminated and web server 200 may offer a predetermined award set by the operator without the player's involvement in the selection, or offer points that can be redeemed as described above. In those cases, the player would be informed of the award s/he is playing for at the start of the game. The award may also be a mystery award offered from a group of awards and chosen at random by web server 200.

An option that may be implemented is to offer the player the ability to exchange an award. This includes exchanging a cash award for a non-cash award, exchanging a non-cash award for a cash award, exchanging a non-cash award for another non-cash award or redeeming points for a cash or a non-cash award. This option may be implemented as part of game play on a NCD where award server 217 makes such offers available at any time after an award has been provided to the player and the player can elect to make an exchange using keyboard 130 or touch screen 125. Or, a voucher exchange may be made available to a player at another location selected by the player for pickup.

Another option that may be implemented in the invention is an advertising element. By adding advertising to various steps of the game, a fee from the advertiser(s) can be collected and the advertising may be used by the casino operator to further increase the payback percentage to the player. This may be done either by applying the full amount collected by the casino for the advertising to the payout amounts in the pay table, or where the casino takes an advertising fee from the advertising revenue but contributes some portion of the advertising revenue to the awards for payout thereby increasing the theoretical payback percentage. Alternatively, the advertising revenue may be given to the player, either in whole or in part to enhance the player's experience.

Figure 7:
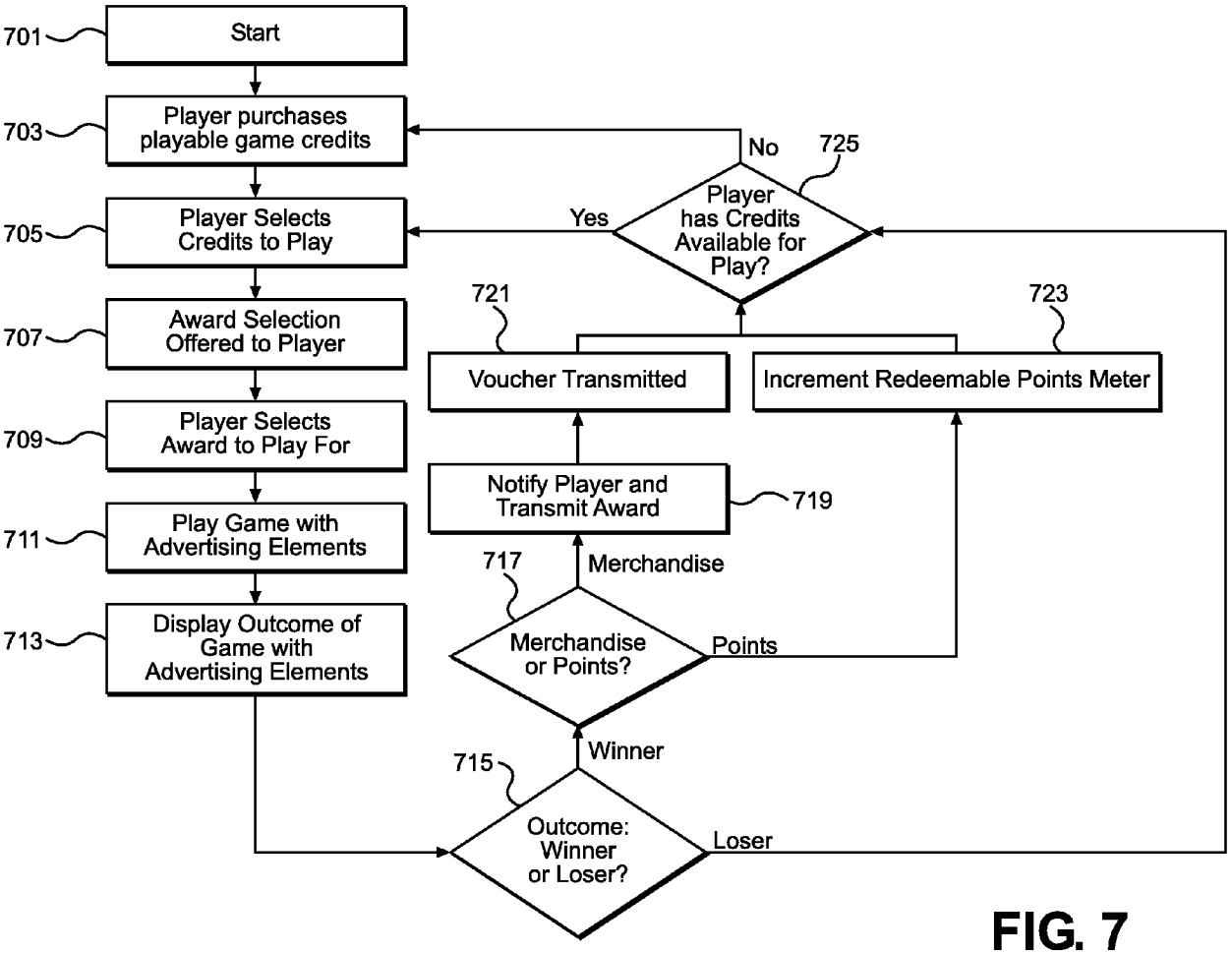
FIG. 7 shows a flow chart of game play with an opportunity for a player to win non-cash awards having an advertising component.

The advertising element is described with respect to FIG. 7 which shows a flow chart of game play with an opportunity for a player to win non-cash awards and having advertising elements. Start 701 represents the point at which a player begins a session on a NCD. The player initially enters credit card or other payment information to make credits available for play on the NCD at step 703. These credits may be displayed to the player on credit meter 300 on display 125. The player then selects the number of credits to play at step 705 using an input device such as touch screen 125 or buttons on a keyboard. Before the game actually begins, a player is offered an award selection at step 707. The award selection may be a single step where the player is given a simple choice among two or more pre-determined awards at a given prize level. For the 150 credit prize, the player may choose a $150 voucher for: 1) an airline flight; 2) a shopping spree at a department store; or 3) a pair of tickets to a sporting event. The choices are made available to the NCD by web server 200 and more particular by award server 217 from awards that are available in award database 223*a*. The awards are entered into web server 200 by the website operator based on agreements reached between the game operator and third party vendors seeking to sell merchandise to consumers playing on NCDs. Award choices are updated on a continuous basis as new awards are added to database 223*a* by the website operator.

To give the player greater control over award selections, an additional step may be added where the awards to be offered are broken out into different award categories. Before choosing a particular award, the player may first choose an award category such as "Travel," "Merchandise," or "Tickets," although it should be understood that there may be many categories from which a player may choose. The categories are maintained on database 223*a* in web server 200. Once a player has selected a category, the player is given an opportunity to select from a group of awards in the category for which to play. If a player has chosen the travel category, the player will be offered the choice of different travel awards such as a flight voucher on an airline, a hotel stay voucher or a car rental voucher. If the player chooses the Merchandise category, s/he may play for a gift voucher of the specified amount at a department store or a shopping spree worth a particular amount at a grocery store. Similarly, for the Ticket category, the player may choose between concert tickets, a sporting event or a play, among many other potential choices.

Selection of the award category and/or the particular award is done on the NCD by presenting selections on display 125 and offering the player an opportunity to make a selection through keyboard 130 or on touch screen game display 125. When the player makes the award selections including either or both of the category choice and/or particular award choice, that information is captured and delivered to award server 217 where it is stored on database 223*a* for reference about the player's choices. The choices, as well as other information about the player from sources such as the player tracking system, hotel database and any other accessible sources that provide data about a player are gathered over time and used to build a player profile. The player profile will allow the advertising server to target particular ads that are of interest to a particular player and will be effective in selling particular vouchers or other merchandise. The player profile information may also be used to prioritize award selections offered to the player.

Once the player has selected the award for which s/he wants to play at step 709, the game is played at step 711, including appropriate game graphics as shown in FIG. 3A on display 125 and accompanying game sounds from speakers on the computing device. During play, advertising server 219 may deliver particular play symbols or other advertising graphics to display 125 that incorporate advertisements based on the player's preferences that are gleaned from the player profile. In a manner similar to how sponsored awards are purchased by a website game operator to be available to a player for delivery by award server 217 from award database 223*a* upon achieving a certain game outcome, the advertising content is sold by the game operator to advertisers. The particular advertisements, including how and when they are presented is up to the game operator and/or the advertiser. Once finalized, the advertising content is stored on database 223*b* for delivery to the NCDs by advertising server 219. An example of a particular advertisement would be to place a company logo on the card backs of a poker game. Alternatively, the advertiser could have their logo appear as a symbol in a spinning reel slot or video slot game depicted on display 125. Or, a pop up ad can appear on display 125 at any time during game play, including at the time the game outcome is reached.

Returning to step 711, the RNG is executed on the controller of web server 200 and a game outcome is chosen. Once the outcome is reached, the outcome is displayed on game display 125 for the player to see at step 713 which outcome and the screen on which it is displayed may incorporate advertising content including within the play symbols. The advertising content is delivered by advertising server 221 from database 223*b*. It is then determined whether the outcome is a winner or loser at step 715. If it is a losing outcome, a determination is made at step 725 whether the player has credits remaining and available for play. If so, the player is returned to step 705. Otherwise, the player is returned to step 703 where he can purchase additional credits to start the process over again. If it is a winning outcome at step 715, the player is notified that s/he has won at step 717 possibly accompanied by other targeted advertising content delivered by advertising server 221 from database 223*b*.

Once it has been established that the player has won at step 715 a determination is made at step 717 whether the player was playing for merchandise or redeemable points. If the player was playing for merchandise, the player is notified at step 719 that s/he has won and the award is transmitted to the player at step 721. If it is determined that the player was playing for points at step 717, redeemable points meter 305 is incremented on display 125 for the appropriate amount. The player may then decide whether to redeem points for an award. Additionally, the player may decide whether to leave purchased credits in his or her account or receive credit in the same manner in which original payment was made by credit card, Paypal or some other form. Or, alternatively the player may be provided with a voucher for credits and/or redeemable points electronically by sending it in an email message, a text message or a twitter message, or by making the voucher electronically available in the player's online loyalty account, or through a social media site such as Facebook, or though any other form. If the player is eligible for a merchandise award, a voucher for the merchandise is printed on a printer, or otherwise provided to the player as described with respect to the award information at step 719, including a bar code or some other form of data security to ensure that the voucher has a unique identification that can be confirmed when presented by the player. The bar code is provided by award server 217 and that same bar code is delivered to the sponsor so that it can be authenticated by the sponsor when presented for use by the player. The printing or transmission of the voucher is also confirmed to award server 217 which removes the award from the available inventory of awards on database 223*a*. When printing or transmitting the award voucher at step 721, such award voucher may include advertising content delivered by advertising server 221.

It should be understood that a player preference setting may be established to allow the player to play multiple games in sequence for the same awards without making award selections each time through the sequence of the flow chart of FIG. 7. In that case, the player may be prompted on display 125 to indicate that s/he would like to continue to play for the same awards until a cash-out or other event occurs.

While FIG. 7 describes a process in which a player makes a choice of an award type and a particular award (see description of steps 705, 707), it should be understood that these steps may be eliminated and web server 200 may offer a predetermined award set by the operator without the player's involvement in the selection. In that case, the player would be informed of the award s/he is playing for at the start of the game. The award may also be a mystery award offered from a group of awards and chosen at random by web server 200.

An option that may be implemented is to offer the player the ability to exchange an award. This includes exchanging a cash award for a non-cash award, exchanging a non-cash award for a cash award, exchanging a non-cash award for another non-cash award or exchanging a non-cash or cash award for redeemable points or vice versa. This option may be implemented as part of game play on a NCD where web server 200 makes such offers available at any time after an award has been provided to the player and the player can elect to make an exchange using inputs such as keyboard 130 or touch screen 125. Or, a voucher exchange may be made available to a player at another location designated by the website operator.

Figure 8:
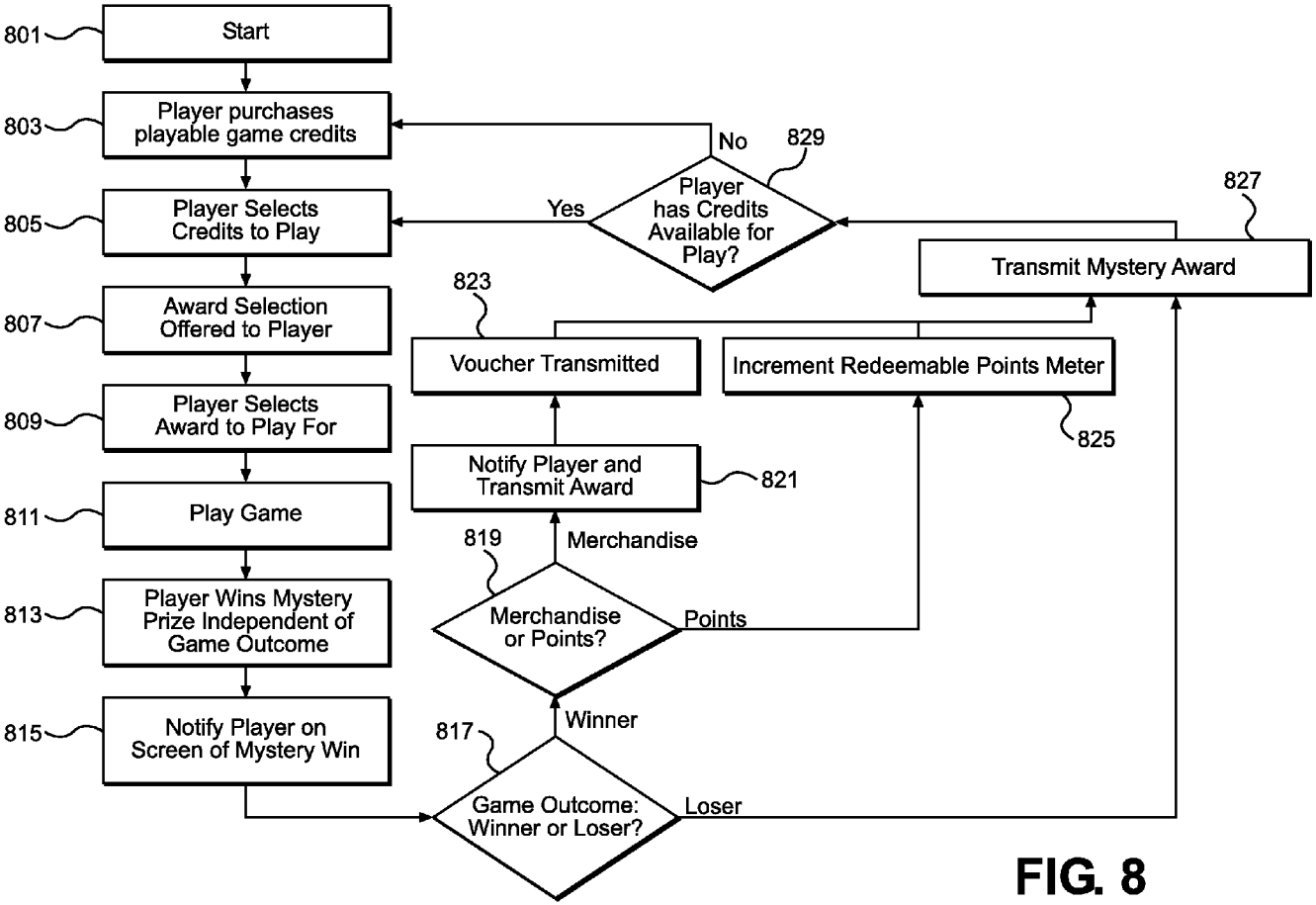
FIG. 8 shows a flow chart of game play with an opportunity for a player to win non-cash awards and having a separate mystery prize.

FIG. 8 shows a flowchart that is the similar to FIG. 6 except that it includes extra steps for providing an additional award type. The additional award type is a mystery prize that is independent of the game outcome. The mystery prize is awarded as a random event and it may be awarded to any player playing at the time it is selected. The extra step for the mystery prize is represented at step 813 which indicates that the player wins the mystery prize independent of game outcome. Another additional step 827 is added to transmit the mystery award to the player. This is done in the same manner as the voucher of FIG. 6 either as an email, an attachment to an email, a text message, a mailing through the postal service or any other electronic or physical delivery of the voucher for use by the player.

Figure 9:
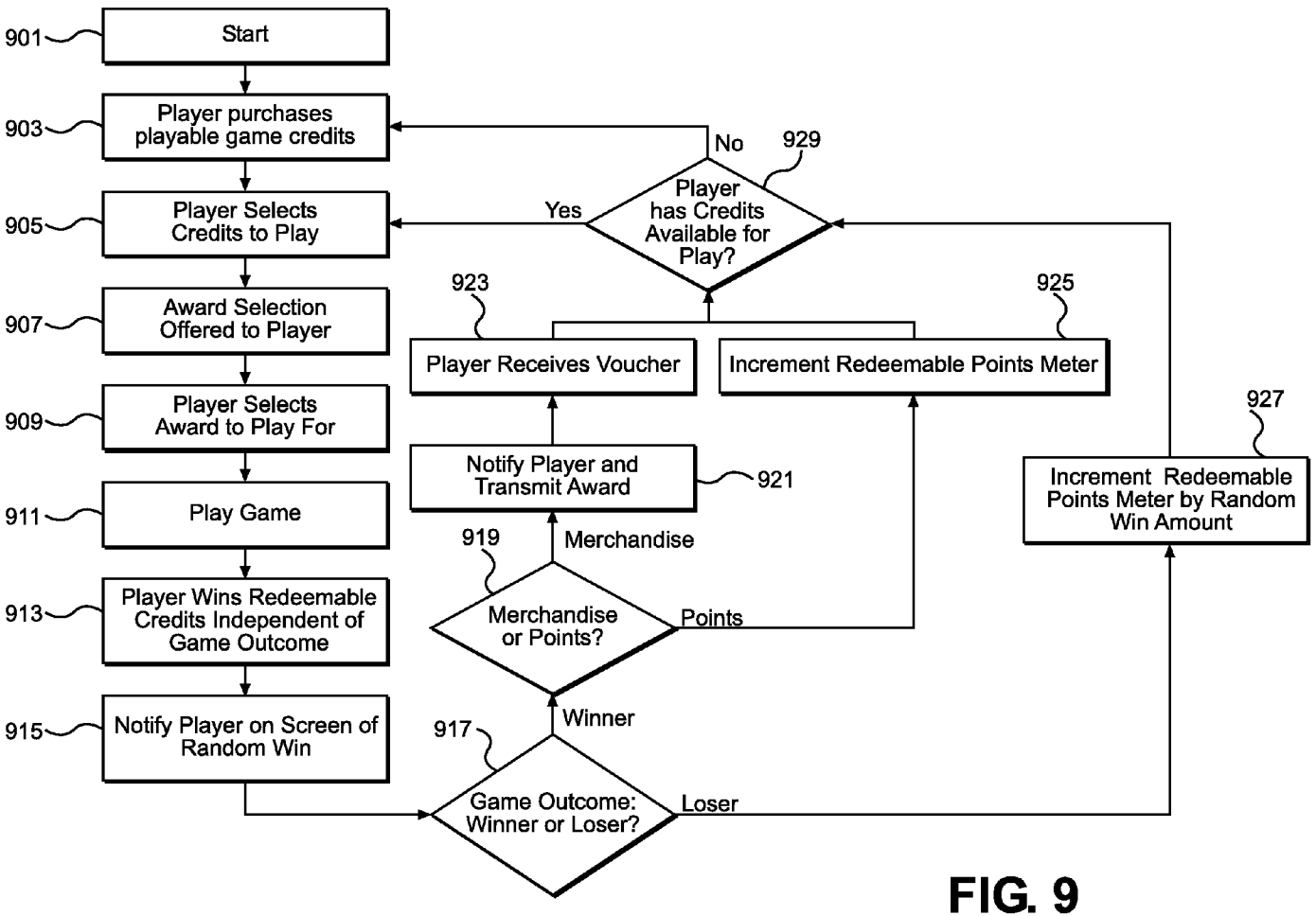
FIG. 9 shows a flow chart of game play with an opportunity for a player to win non-cash awards and having a separate random award of redeemable points.

FIG. 9 shows a flowchart that is similar to FIG. 6 except that it includes extra steps for providing an additional award type that is specifically redeemable credits. The additional award of credits is a random prize that is independent of the game outcome. The credits awarded occur as a random event which may be awarded to any player playing at the time it is selected. The extra step for the random award is represented at step 913 which indicates that the player wins the redeemable credits independent of game outcome. Another additional step 927 is added to increment the redeemable points on the redeemable points meter by the amount won.

While the invention has been described with respect to the figures, it will be appreciated that many modifications and changes may be made by those skilled in the art without departing from the spirit of the invention. For example, any particular game incorporating the invention may have a set paytable where the player is not given a choice of awards. Instead, the awards for any given outcome are set and may not be changed by the player. It's also possible to implement the invention where any given outcome may be eligible for any one of a group of different awards where the award provided to the player is selected at random from the group. Any variation or derivation from the above description and drawings are included in the scope of the present invention as defined by the claims.

What is claimed is:

1. A system for playing a game on a network-connected device with an opportunity to win an award, comprising:

a server including a controller running a random number generator implemented in software for generating random numbers that determine an outcome of the game and that correspond to a predefined set of game outcomes including winning and losing outcomes wherein a theoretical player return percentage of an award set provided for winning outcomes on the game to a player exceeds one hundred percent and wherein a theoretical game operator return percentage of the award set to a game operator is less than one hundred percent and further wherein a theoretical return percentage difference between the theoretical player return percentage and the theoretical game operator return percentage is funded by at least one non-cash award having a value to the player that is greater than a cost to the game operator;

a network connected device having a display in communication with the server for displaying game play and game outcomes to a player; and an award generator in communication with the controller for providing an award to the player upon a winning outcome being achieved wherein the award set includes the at least one non-cash award.

2. The system of claim 1 wherein the non-cash award is provided to the player in a form from the group comprising:

a) an electronic communication to the player including information for the player to redeem the non-cash award in the form of: i) an email message; ii) a text message; iii) an indicator on a social media website; iv) a printable voucher that may be used to purchase a product or service, or portion thereof; or v) any other electronic voucher provided to the player;

b) a physical item;

c) an electronic or magnetic card holding value that may be used to purchase a product or service, or portion thereof;

d) another non-cash item of value; or e) a designation by the player to provide any of (a)-(d) to a third party.

3. The system of claim 1 further comprising a user interface on the network connected device through which the player may select preferences for the non-cash award to be provided to the player upon achieving a winning outcome on the game.

4. The system of claim 3 further comprising an award server for determining the particular non-cash awards available and for determining the particular non-cash awards to be offered to a particular player based on preferences selected by the player.

5. The system of claim 4 further comprising a database for storing information about the player and which information is used by the award server to determine the particular non-cash awards to be offered to a particular player.

6. The system of claim 5 wherein the award server gathers information about a particular player and stores the information in the database.

7. The system of claim 1 further comprising an advertising server connected to the server for generating advertisements that are displayed to the player on the display of the network connected device.

8. The system of claim 7 wherein an advertisement is displayed in a game element or portion thereof in a game played on the network connected device.

9. The system of claim 7 wherein revenue generated by advertisements is used to fund the theoretical return percentage difference of the game played on the network connected device.

10. The system of claim 7 wherein revenue generated by advertisements is used to pay in whole or in part for non-cash awards provided to a player.

11. The method of claim 7 wherein revenue generated by advertisements is provided to the player in whole or in part.

12. The system of claim 1 wherein an award exchange opportunity is provided to the player to make an exchange of any one of the types from the group: a) a cash award for a non-cash award; b) a non-cash award for a cash award; or c) a non-cash award for a different non-cash award.

13. The system of claim 1 wherein at least one non-cash award is purchased by the game operator at a first value and presented to the player at a second value that is higher than the first value to account for the theoretical return percentage difference wherein the player return percentage is higher than 100 percent and wherein if the second value was set to be equal to the first value, the payback percentage would be less than 100 percent.

14. The system of claim 13 wherein the value of the theoretical return percentage difference is provided to the player in whole or in part.

15. The system of claim 1 wherein the network connected device is one of a type from a group comprising a: a) smartphone; b) tablet computer; c) laptop computer; d) desktop computer; e) computing terminal; f) home video gaming device; or g) portable video gaming device.

16. In a networked system including at least one network connected device on which a game is played and a server with a database for maintaining records of awards, a method of playing a game on the network-connected device wherein the networked system includes a controller that executes a random number generator program implemented in software and the network connected device includes a display viewable by a player, comprising:

placing a wager to initiate play of a game on the network-connected device;

providing an award set corresponding to a plurality of game outcomes including at least one outcome that results in a non-cash award, wherein a theoretical player return percentage of the award set to the player exceeds one hundred percent and a theoretical game operator return percentage of the award set to a game operator is less than one hundred percent, and further wherein a return percentage difference between the theoretical player return percentage and the theoretical game operator return percentage is funded by at least one non-cash award having a value to the player that is greater than a cost to the operator;

selecting a random number upon running the random number generator on the controller that is converted to one of the plurality of game outcomes;

displaying the game outcome on the display;

determining whether the game outcome is a winning outcome, wherein if the game outcome is a winning outcome, determining whether the winning outcome is one for a game credits award or a non-cash award;

awarding a non-cash award for a winning outcome corresponding to the non-cash award.

17. The method of claim 16 wherein the non-cash award is of a type from the group comprising:

a) an electronic communication to the player including information for the player to redeem the non-cash award in the form of: i) an email message; ii) a text message; iii) an indicator on a social media website; iv) a printable voucher that may be used to purchase a product or service, or portion thereof; or v) any other electronic voucher provided to the player;

b) a physical item;

c) an electronic or magnetic card holding value that may be used to purchase a product or service, or portion thereof;

d) another non-cash item of value; or e) a designation by the player to provide any of (a)-(d) to a third party.

18. The method of claim 16 further comprising providing a user interface on which the player may select preferences for the non-cash award to be provided to the player upon achieving a winning outcome on the game.

19. The method of claim 18 further comprising providing an advertising server connected to the network for generating advertisements that are displayed to the player on the display of a network connected device at which a player is playing.

20. The method of claim 19 wherein an advertisement is displayed in a game element or portion thereof in a game played on a network connected device.

21. The method of claim 19 wherein revenue generated by advertisements is used to fund the return percentage difference of a game on a network connected device.

22. The method of claim 19 wherein revenue generated by advertisements is used to pay in whole or in part for non-cash awards provided to a player.

23. The method of claim 19 wherein revenue generated by advertisements is provided to the player in whole or in part.

24. The method of claim 16 further comprising providing an award server for determining the particular non-cash awards available and for determining the particular non-cash awards to be offered to a particular player based on preferences selected by the player.

25. The method of claim 24 further comprising providing a database for storing information about the player and which information is used by the award server to determine the particular non-cash awards to be offered to a particular player.

26. The method of claim 24 wherein the award server gathers information about a particular player and stores the information in the database.

27. The method of claim 16 wherein an award exchange opportunity is provided to the player to exchange any one of a type of exchanges from a group comprising: a) a cash award for a non-cash award; b) a non-cash award for a cash award; or c) a non-cash award for a different non-cash award.

28. The method of claim 16 wherein the computing devices are at least one of a type from a group comprising: a) smartphones; b) tablet computers; c) laptop computers; d) desktop computers; e) computing terminals; f) home video gaming devices; or g) portable video gaming devices.

29. The system of claim 16 wherein the non-cash award is purchased by the game operator at a first value and presented to the player at a second value that is higher than the first value to account for the return percentage difference wherein the player return percentage is higher than 100 percent.

30. The system of claim 29 wherein the value of the player return difference is provided to the player in whole or in part.

* * * * *